US005934983A

United States Patent [19]

Wada et al.

[11] Patent Number: 5,934,983

[45] Date of Patent: Aug. 10, 1999

[54] DOUBLE-SIDE GRINDING METHOD AND DOUBLE-SIDE GRINDER

[75] Inventors: Yoshiki Wada; Yoshihiro Hara; Norihide Tokunaga, all of Kobe; Gisaburo Kondoh, Osaka, all of Japan

[73] Assignee: Kabushiki Kaisha Kobe Seiko Sho, Kobe, Japan

[21] Appl. No.: 08/834,598

[22] Filed: Apr. 7, 1997

[30] Foreign Application Priority Data

Apr. 8, 1996 [JP] Japan ..... 8-085165
May 13, 1996 [JP] Japan ..... 8-117923

[51] Int. Cl.[6] ..... B24B 7/19; B24B 7/30

[52] U.S. Cl. ..... 451/63; 451/261; 451/57; 451/262

[58] Field of Search ..... 451/261, 262, 451/245, 282, 267, 286, 331, 260, 57, 63, 41, 28, 10

[56] References Cited

U.S. PATENT DOCUMENTS

| | | | |
|---|---|---|---|
| 2,636,322 | 4/1953 | Carlson et al. | 451/261 |
| 3,182,428 | 5/1965 | Hannon | 451/269 |
| 3,393,473 | 7/1968 | Rimmer | 451/261 |
| 3,859,756 | 1/1975 | Zerbola | 451/269 |
| 3,939,514 | 2/1976 | Cook | 451/261 |
| 4,586,296 | 5/1986 | Saunders | 451/262 |
| 4,587,765 | 5/1986 | Matsui | 451/28 |
| 4,753,045 | 6/1988 | Fetouh et al. | 451/261 |
| 5,121,572 | 6/1992 | Hilscher | 451/262 |
| 5,140,774 | 8/1992 | Onodera | 451/269 |
| 5,484,327 | 1/1996 | Kovach | 451/49 |

*Primary Examiner*—Timothy V. Eley
*Assistant Examiner*—Derris Holt Banks
*Attorney, Agent, or Firm*—Hazel & Thomas, P.C.

[57] ABSTRACT

The present invention provides a double-side grinder capable of grinding double-sides of an aluminum disk highly efficiently and affording a ground aluminum disk free of end-face flaw and superior in both surface accuracy and dimensional accuracy while obviating the occurrence of grinding marks extending in different directions. A rough grinding mechanism having rough grinding wheels disposed opposedly to each other is mounted, a finish grinding mechanism having finish grinding wheels disposed opposedly to each other is mounted just after the rough grinding mechanism, and a belt-like carrier having a large number of pockets formed longitudinally of the carrier with aluminum disks engaged therein is passed between the rough grinding wheels and the finish grinding wheels, thereby allowing double-sides of each aluminum disk to be subjected to rough grinding and finish grinding in a continuous manner. Moreover, work rotation braking means each comprising a braking member of rubber for pressing at least one side of an aluminum disk to brake the rotation of the disk and a coiled spring for pressing the braking member to the aluminum disk are disposed on both carrier incoming and outgoing sides of a pair of grinding wheels to brake the rotation of the aluminum disk caused by follow-up rotation thereof together with rotation of the grinding wheels when the disk gets in between the grinding wheels and also when it leaves the grinding wheels.

17 Claims, 10 Drawing Sheets

DOUBLE-SIDE GRINDING METHOD AND DOUBLE-SIDE GRINDER

BACKGROUND OF THE INVENTION

1. Field of the Invention

The present invention relates to a method for grinding an aluminum substrate and a double-side grinder using the said method. More particularly, the present invention is concerned with the technical field of an aluminum substrate grinding method for grinding an aluminum substrate which, for examples, serves as a magnetic disk to be used as a memory in a computer.

2. Description of the Prior Art

As known well, as to the magnetic disk used in a memory such as a computer for example, the head flying height has been decreased for improving the recording density, and the reduction in size of the disk is also been under way. At the same time, for the disk substrate, not only a further improvement in surface smoothness and morphological accuracy but also the reduction in both thickness and size has been required.

Heretofore, an aluminum substrate has been fabricated by a method involving subjecting a rolled aluminum plate to blanking with a press into a disk shape to form an aluminum substrate, then subjecting the aluminum substrate to annealing for strain removal, thereafter attaching PVA grinding wheels to upper and lower surface plates of a double-side grinder, holding the aluminum substrate in between the upper and lower grinding wheels and grinding it at a low speed. This is because the said method affords an aluminum plate superior characteristics in both surface accuracy and dimensional accuracy.

However, when the aluminum substrate is loaded onto and unloaded from a carrier, it is necessary to interrupt the operation of the double-side grinder used. Thus, a problem remains to be solved such that it is impossible to expect a further improvement in productivity of the aluminum substrate.

To solve the above-mentioned problem, that is, to improve productivity, a study has so far been made about adopting a double-side grinder which grinds double-sides of an aluminum substrate continuously without interruption of operation of the grinder while allowing a disk- or belt-like carrier to pass, together with the aluminum plate, between a pair of grinding wheels rotating at a high speed. Such a double-side grinder is of a known type, but various improvements have been applied thereto for grinding such a soft material as the aluminum substrate. For example, double-side grinders of such a type are disclosed in Japanese Patent Publication Nos. 37378/80 and 304854/94. These double-side grinders will be outlined below.

A description will first be directed to the double-side grinder disclosed in Japanese Patent Publication No. 37378/80 with reference to FIG. 10(*a*) which illustrates an outline of the grinder and FIG. 10(*b*) which illustrates a principal portion of the grinder on a larger scale, and using the same designations and reference numerals as those described in the specification thereof.

A belt 53 is stretched between and straddles a driving roll 51 and a driven roll 52 which is positioned a predetermined distance from the driving roll 51. The belt 53 is a metallic belt having pockets 55, the pockets 55 being formed at predetermined intervals and conforming approximately to a small thin piece 54 as a work. Plural such small thin pieces 54 are stacked and are respectively brought into engagement in the pockets 55 by means of an automatic inserting device (not shown) indicated with an arrow 58.

The numeral 59 denotes a guide member disposed above the automatic inserting device 58, while the numeral 60 denotes a guide member disposed in font of the device 58. Numeral 61 denotes a disk-like rotary machining tool, which is provided in a pair and which is disposed sideways of the guide members 59,60 and in parallel with the belt 53. The paired disk-like rotary machining tools 61,61 are constructed so as to be rotated with rotating shafts 62,62. Accordingly, upon counterclockwise rotation of the driving roll 51, double-sides of the small thin piece engaged in each pocket 55 of the belt 53 are ground by the disk-like rotary machining tools 61,61.

Now, a description will be given of the double-side grinder disclosed in Japanese Patent Laid Open No. 304854/94 with reference to FIG. 11 which is a schematic plan view, with an upper grinding wheel omitted. According to this grinder, utilizing a grinding force induced at the time of grinding double-sides of a work W, an outer peripheral surface Wa of the work is pressed against the outer peripheral surfaces as friction surfaces of friction wheels 65 and 66 rotating in positions outside a grinding wheel 67, and the work is rotated forcibly by virtue of the resulting frictional force between the fiction wheels 65,66 and the work W. With this construction, a drive system for driving the work W rotatively can be disposed outside the grinding wheel 67 to grind various works from extremely thin works up to normal works. It is possible to improve the grinding accuracy for works.

Another description will be further directed to a double-side grinder disclosed in Japanese Patent Laid Open No. 18445/95 with reference to FIG. 8 and using the same designations and reference numerals as those described in the specification thereof. A disk-shaped carrier 44 having a plurality of pockets 46 capable of carrying works thereon is rotated between a pair of opposed grinding wheels 42,42, the pockets 46 being formed on a circumference centered at the rotational center of the carrier, to continuously grind double-sides of the works received in the pockets 46 of the carrier 44. Numeral 47 denotes a loading pusher for loading works into the pockets 46, while numeral 48 denotes an unloading pusher for unloading ground works from the pockets 46.

When disk-shaped works are to be ground on double-sides thereof while being carried on or received in the above conventional carrier, if a pair of grinding wheels disposed opposedly to each other are rotated at an equal speed in directions opposite to each other, the forces which the disk-shaped works receive from the grinding wheels during grinding offset each other and become zero theoretically, so that the works are not moved in any direction and hence do not rotate.

Actually, however, the aforesaid forces do not become completely zero due a slight difference in the surface condition between the paired grinding wheels or due to a slight difference in the state of contact between the disk-shaped works and the grinding wheels. In many cases the works undergo a force acting in a certain direction. Particularly, when a disk-shaped work is to leave the paired grinding wheels and when only half or less of the work surface to be ground is being ground with grinding wheels, as shown in FIG. 9 which illustrates in what state grinding marks of each work occur, the work will undergo a follow-up rotation continuously or intermittently with rotation of any one grinding wheel, so that grinding marks extending in a direction different from the previous grinding marks occur on the work surface to be ground. Further, when each disk-shaped work gets in between the paired grinding wheels and when the work leaves the paired grinding wheels, the work rotates due to its follow-up rotation and rubs against an inside wall of the associated pocket in the carrier, resulting in that a peripheral edge of the work is flawed and hence the appearance of the work is deteriorated.

Thus, in the case of grinding double-sides of a disk-shaped work by means of a double-side grinder, it is difficult to avoid the occurrence of grinding marks of different directions or avoid flawing of a work edge. For this reason, for double-side ground products of which it is required to be uniform in grinding marks on double-sides or of which it is required to be flaw-free at an edge, it is impossible to use a double-side grinder for grinding disk-shaped works and therefore the improvement of productivity has been obstructed. Further, the amount of residual stress becomes great, so that not only the resulting disk-like double-side ground product may become wavy but also it is impossible to adopt a double-side grinder for grinding double-sides of a disk-shaped work or which high flatness is required. Thus, the prior art has developed such problems to be solved.

SUMMARY OF THE INVENTION

Accordingly, it is the first object of the present invention to provide a double-side grinding method and a double-side grinder which, in grinding double-sides of a disk-shaped work, can obviate the occurrence of grinding marks extending in different directions on double-sides of the work by braking the rotation of the work on a carrier outgoing side of grinding wheels. According to the grinding method and machine of the invention, it is possible to obviate the flaws of a work edge and the occurrence of grinding marks extending in different directions on double-sides of a work.

Next, reference will be made to the problem that grinding wheels used are apt to cause loading, or clogging, in the case where the small thin piece used as a work is formed of a soft metal such as aluminum. It goes without saying that the loading of grinding wheels can be prevented by using grinding wheels of coarse abrasive grains. However, this gives rise to a tendency that the surface of the resulting ground product becomes more rough. There also arises the problem that the aluminum substrate, which is thin, warps due to a residual stress induced on its surface. Conversely, the finer the abrasive grain of grinding wheels, the less rough the work surface. However, the aluminum substrate as obtained by blanking from a rolled stock cannot be made large in the depth of cut due to the presence of a hard oxide layer on its surfaces, resulting in a longer grinding time required, and hence not only is the productivity deteriorated but also the loading becomes more conspicuous.

Further, in all of the foregoing convention grinders there are provided only a pair of grinding wheels, and therefore if grinding is to be performed in two stages, it is necessary to provide halfway a conveyance device for the conveyance of small thin pieces or works. Of course, if two double-side grinders are arranged side by side, it is possible to omit such conveyance device. In this case, however, there occurs a positional deviation between the two double-side grinders for a long time. Therefore, it becomes necessary to perform periodic inspection and repair, thus giving rise to the problem that the running cost increases.

Accordingly, it is the second object of the present invention to provide a double-side grinding method and a double-side grinder which are superior in grinding efficiency and which can afford an aluminum substrate having high surface accuracy and dimensional accuracy.

Heretofore, a metallic guide plate has been used for preventing the drop of small thin pieces or works from a carrier of a double-side grinder. However, in the case where the small thin piece or work is a soft aluminum substrate, the surface of the aluminum substrate is apt to be flawed because the aluminum substrate comes into sliding contact with the guide plate, thus causing the problem of deteriorated yield.

It is therefore the third object of the present invention to provide an aluminum substrate grinding method and a double-side grinder for an aluminum substrate which are less likely to cause flaws on the surface of the aluminum substrate.

The present invention has been accomplished in view of the above circumstances. Accordingly, in order to achieve the above first object, the present invention provides a double-side grinding method for a disk-shaped work, involving passing a carrier between grinding wheels disposed in opposed relation to each other and adapted to rotate about a common axis, and continuously grinding double-sides of many disk-shaped works held by the carrier to obtain disk-shaped double-side ground products, the said method being characterized in that when each disk-shaped work leaves the grinding wheels, the rotation of the work is braked.

The present invention further provides a double-side grinding method for a disk-shaped work, involving passing a carrier between grinding wheels disposed in opposed relation to each other and adapted to rotate about a single axis, and continuously grinding many disk-shaped works held by the carrier to afford disk-shaped double-side ground products, the said method being characterized in that the rotation of the work is braked when the work enters between the grinding wheels and also when the work leaves the grinding wheels.

The present invention further provides a double-side grinder for a disk-shaped work, having grinding wheels disposed in opposed relation to each other and adapted to rotate about a common axis, and a carrier adapted to pass between the grinding wheels while holding many disk-shaped works in the longitudinal direction, the said grinder being characterized in that a work rotation braking means for braking the rotation of each disk-shaped work held by the carrier is provided on at least one side of the carrier on a carrier outgoing side of the grinding wheels.

The present invention further provides a double-side grinder for a disk-shaped work, having grinding wheels disposed in opposed relation to each other and adapted to rotate about a common axis, and a carrier adapted to pass between the grinding wheels while holding a plurality of disk-shaped works, the said grinder being characterized in that work rotation braking means for braking the rotation of each disk-shaped work held by the carrier is provided on at least one side of the carrier on a carrier incoming side of the grinding wheels and also on at least one side of the carrier on a carrier outgoing side of the grinding wheels.

The present invention further provides a double-side grinder for disk-shaped works, characterized in that the aforesaid work rotation braking means is a solid body which comes into contact with a surface of each disk-shaped work and whose hardness is lower than that of the work.

The present invention further provides a double-side grinder for disk-shaped works, characterized in that the aforesaid work rotation braking means comprises a solid body which comes into contact with a surface of each disk-shaped work and whose hardness is lower than that of the work, and a pressing mechanism for pressing the said solid body against a surface of each disk-shaped work at a predetermined certain force.

The present invention further provides a double-side grinder for disk-shaped works, characterized in that the aforesaid work rotation braking means comprises a roller-shaped solid body which comes into rolling contact with a surface of each disk-shaped work and whose hardness is lower than that of the work, and a pressing mechanism for pressing the roller-shaped solid body against a surface of each disk-shaped work at a predetermined certain force.

The present invention further provides a double-side grinder for disk-shaped works, characterized in that the aforesaid solid body is an elastic resin.

The present invention further provides a double-side grinder for disk-shaped works, wherein the aforesaid work rotation braking means is a thin resinous plate whose front end portion comes into contact with a surface of each disk-shaped work.

The present invention further provides a double-side grinder for disk-shaped works, characterized in that the aforesaid work rotation braking means is a brush whose front end portion comes into contact with each disk-shaped work in a bent state in the carrier moving direction.

The present invention further provides a double-side grinder for disk-shaped works, characterized in that the aforesaid work rotation braking means is a highly viscous fluid for immersion therein of the carrier and each disk-shaped work.

The present invention further provides a double-side grinder for disk-shaped works, characterized in that the work rotation braking means located on the carrier incoming side of the grinding wheels is a solid body whose hardness is lower than that of the disk-shaped works, and the work rotation braking means located on the carrier outgoing side of the grinding wheels is a highly viscous fluid for immersion therein of the carrier and each work.

In order to achieve the foregoing second object, the present invention provides an aluminum substrate grinding method, involving passing or inserting a belt-like carrier between grinding wheels disposed in opposed relation to each other and adapted to rotate about a common axis, and grinding double-sides of the aluminum substrate which is held by the carrier, the said method being characterized in that a rough grinding using coarse grinding wheels of #400~1000 and a finish grinding using finish grinding wheels of #1000~8000 are performed in a continuous manner to grind the aluminum substrate.

Further, for achieving the foregoing second object, the present invention provides a double-side grinder comprising a belt-like carrier for holding an aluminum substrate in the longitudinal direction of the carrier, a carrier moving mechanism which applies a tension to the carrier and which causes the carrier to move, a pair of rough grinding wheels adapted to rotate about a common axis to grind the aluminum substrate roughly, and a pair of finish grinding wheels for finish-grinding the aluminum substrate after rough grinding with the paired coarse grinding wheels.

Further, in order to achieve the foregoing second object, the present invention provides a double-side grinder characterized in that the aforesaid paired rough grinding wheels comprise an abrasive gram of #400~1000, and the aforesaid paired finish grinding wheels compose an abrasive grain of #1000~8000.

In order to achieve the aforesaid third object, the present invention provides a double-side grinder characterized in that a non-contact type work holding guide for ejecting a fluid to an aluminum substrate held by the carrier to prevent drop-out of the same substrate from the carrier is provided outside the carrier.

DETAILED DESCRIPTION OF PREFERRED EMBODIMENTS

A double-side grinder for disk-shaped works, which realizes the method of the invention, will be described hereinunder as an embodiment of the invention, with reference to FIG. 1(*a*) which is a perspective view showing a schematic construction of the grinder and FIG. 1(*b*) which is a view as seen in the direction of arrow A in FIG. 1(*a*).

Figure 1A:
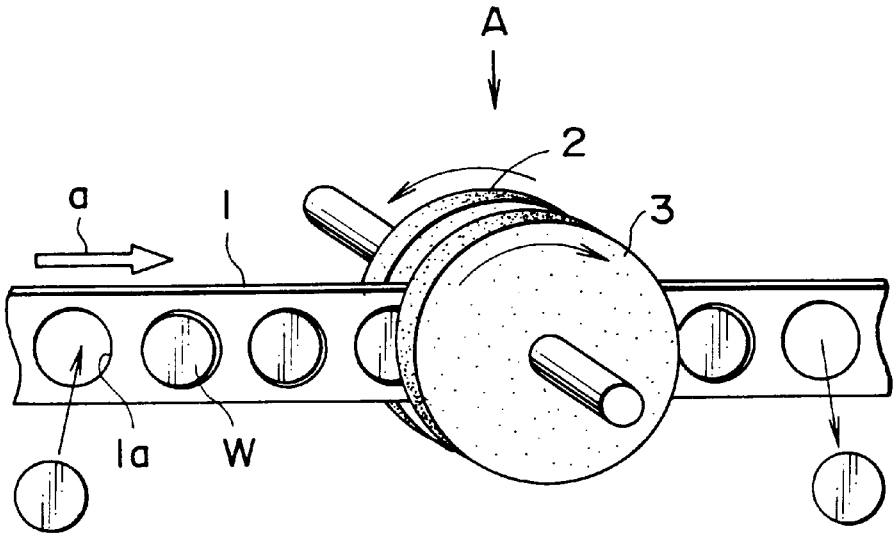
FIG. 1(*a*) is a perspective view showing a schematic construction of a double-side grinder to which is applied a rotation braking means according to a first embodiment, and FIG. 1(*b*) is a view as seen in the direction of arrow A in FIG. 1.
Figure 1B:
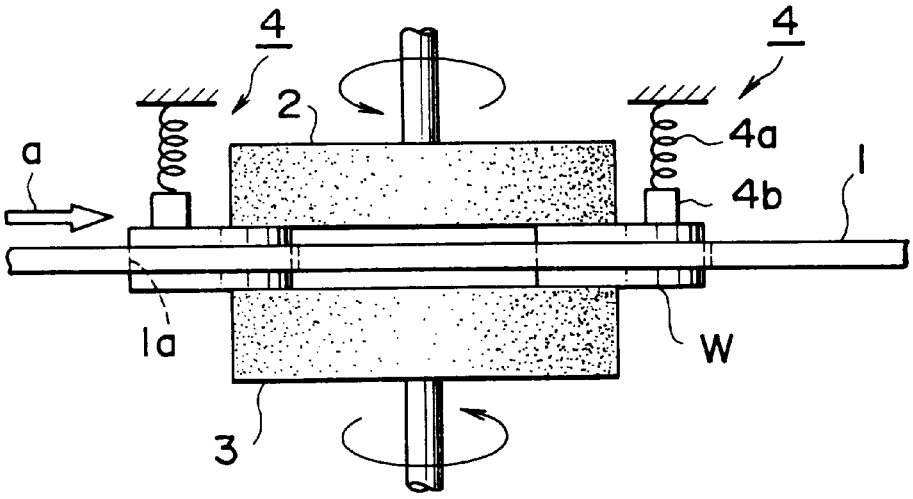

In the same figures, the reference numeral 1 denotes a carrier which is moved in the direction of a rightward arrow a in FIG. 1(*a*) and which is constituted by a metallic belt having plural pockets 1*a*, the pockets 1*a* being cavities formed at predetermined intervals in the longitudinal direction for engagement therein of disk-shaped works W. The carrier I is constructed so as to be passed between a pair of grinding wheels 2 and 3 while holding the disk-shaped works W in the pockets 1*a*, the paired grinding wheels 2 and 3 being disposed in opposed relation to each other and adapted to be rotated in directions opposite to each other. The opposed faces of the paired grinding wheels 2 and 3 are not completely parallel with each other, but are actually arranged at a slight angle so that the carrier incoming side is wide and the carrier outgoing side is narrow.

Work rotation braking means 4 to be described later are disposed on the carrier incoming side and the carrier outgoing side, respectively, of the paired grinding wheels 2 and 3. As shown in FIG. 1(*b*), the work rotation braking means 4 each comprise a coiled spring 4*a* as a pressing mechanism anchored at one end thereof for pressing against each disk-shaped work W with a predetermined certain force, and a braking member 4*b* which is a solid block formed of an elastic resin, e.g. rubber, lower in hardness than the work W. The rotation of the work W is braked by ping the braking member 4*b* against the work W with a spring back force of the coiled spring 4*a*. Although in the illustrated embodiment the work rotation braking means 4 are disposed on only one side of the carrier 1, it is desirable, for improving the grinding accuracy of the work W, to dispose the work rotation braking means 4 on double-sides of the carrier because the work is pressed from double-sides. As to the pressing mechanism, it may be an air cylinder for example.

Figure 2:
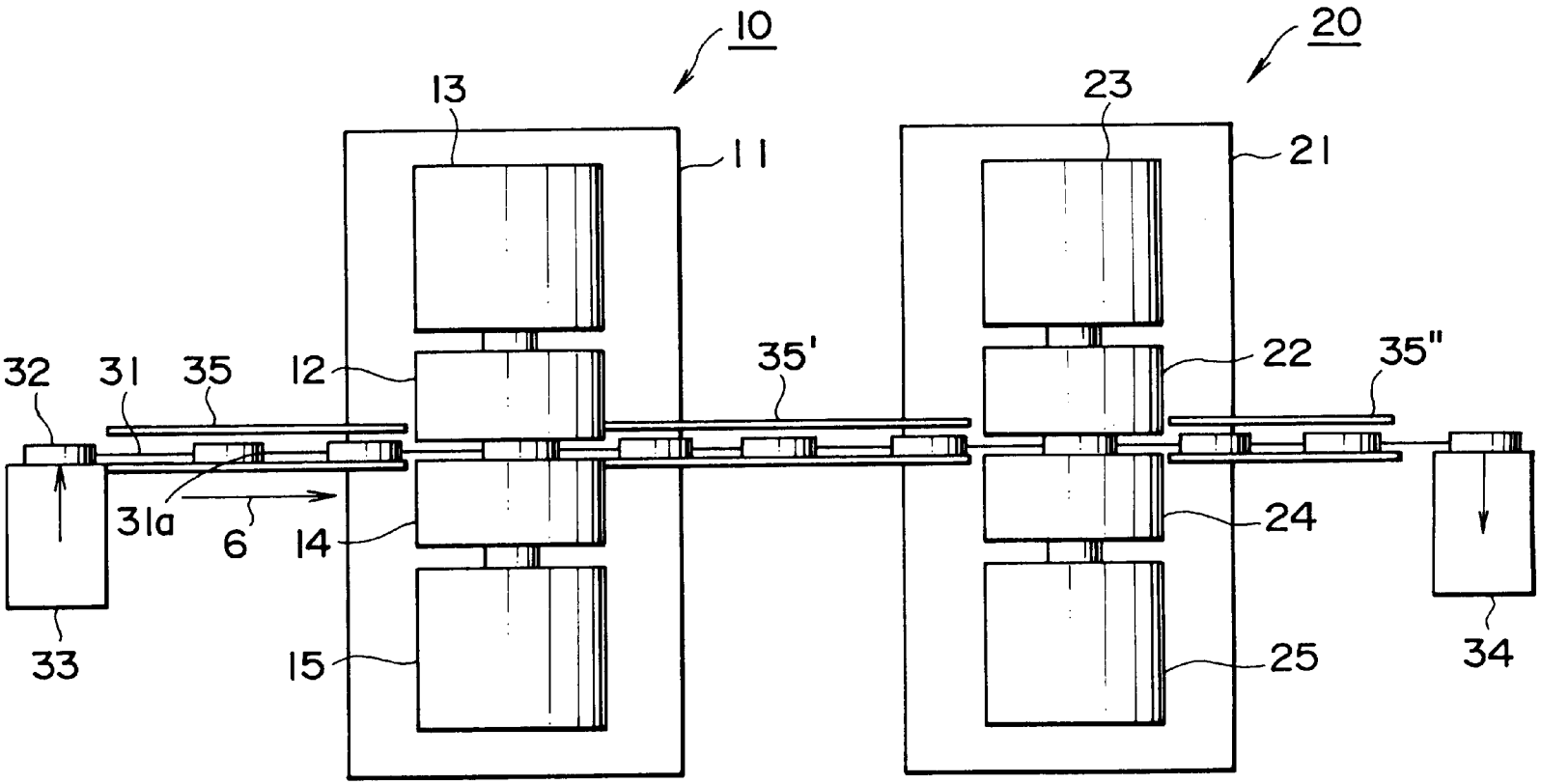
FIG. 2 is a schematic construction diagram of the double-side grinder using two sets of grinding wheels which are rough grinding wheels and finish grinding wheels.

A double-side grinder embodying the present invention and realizing an aluminum substrate grinding method according to the invention will now be described with reference to FIG. 2 which is a diagram explanatory of a schematic construction of the grinder. In the same figure, the reference numeral 31 denotes a carrier which is constituted by a metallic belt having a plurality of pockets 31*a* at predetermined intervals in the longitudinal direction of the carrier for engagement therein of aluminum substrates 32, the carrier 31 being moved in the direction of a rightward arrow 36 in FIG. 2. On the left-hand side in the same figure of the carrier 31 is disposed a loading mechanism 33 for loading the aluminum substrates 32 Lovely into engagement with the pockets 31*a*, while on the right-hand side of the carrier is disposed an unloading mechanism 34 for unloading the aluminum substrates 32 from the pockets 31*a*. For example, the carrier moving mechanism may comprise a feed roll with the carrier wound thereon and a take-up roll for taking up the carrier from the feed roll, or may comprise a driving wheel and a driven wheel, with an endless carrier entrained on both wheels.

Between the loading mechanism 33 and the unloading mechanism 34 is disposed a rough grinding mechanism 10 at a position dose to the loading mechanism, while at a position close to the unloading mechanism 34 is disposed a finish grinding mechanism 20. The rough grinding mechanism 10 of a construction to be described later is for roughly grinding double-sides of the aluminum substrates 32 carried on the carrier 31. The finish grinding mechanism 20 of a construction to be described later is for finish-grinding double-sides of the aluminum substrates 32 after ground roughly by the rough grinding mechanism 10.

The rough grinding mechanism 10 comprises a rough grinding wheel 12 which is rotated by a grinding wheel rotating device 13 to roughly grind one side of each aluminum substrate 32 carried on the carrier 31, and a rough grinding wheel 14 which is rotated by a grinding wheel rotating device 15 to roughly grind the other side of the aluminum substrate 32. The spacing between the rough grinding wheels 12 and 14 is adjusted by a moving table 11. The finish grinding mechanism 20 comprises a finish grinding wheel 22 which is disposed on the moving table 21 and which is rotated by a grinding wheel rotating device 23 to finish-grind one side of the aluminum substrate 32 after being ground roughly by the rough grinding wheel 12 in the rough grinding mechanism 10, and a finish grinding wheel 24 which is disposed on the moving table 21 and which is rotated by a grinding wheel rotating device 25 to finish-grind the other side of the aluminum substrate 32 after being ground roughly by the rough grinding wheel 14 in the rough grinding mechanism 10. The spacing between the finish grinding wheels 22 and 24 is adjusted by the moving table 21.

Between the loading mechanism 3 and the rough grinding mechanism 10, between the rough grinding mechanism 10 and the finish grinding mechanism 20, and between the finish grinding mechanism 20 and the unloading mechanism 34, are disposed, at positions close to the carrier 31, non-contact type work holding mechanism 35, 35' and 35" which have a large number of fine holes (not shown) to eject a fluid to double-sides of the aluminum substrates carried on the carrier 31. The non-contact type work holding mechanisms 35, 35' and 35", which are arranged in parallel with the carrier 1, are for preventing the drop-out of the aluminum substrates 32 from the carrier 31 by ejecting fluid from those fine holes. As the fluid used may be a gas, from the economic standpoint, it is desirable to use a grinding fluid stored in a grinding fluid tank which is sure to be provided in this type of a grinder.

The following description is now provided about how to use the double-side grinder of the above construction. When an aluminum substrate 32 is engaged in a pocket 31*a* by the loading mechanism 33 and is fed between the rough grinding wheels 12 and 14 of the rough grinding mechanism 10, double-sides of the aluminum substrate 32 are roughly ground into a predetermined size by the rough grinding wheels 12 and 14. This rough grinding can be done at a high level of efficiency because of a coarse abrasive grain, making clogging of both grinding wheels difficult. Then, the aluminum substrate 32 thus ground roughly is fed between the finish grinding wheels 22 and 24 of the finish grinding mechanism 20 and is finish-ground by these finish grinding wheels, whereby surface roughness and warp of the aluminum substrate 32, which are attributable to the rough grinding, can be corrected (the surface layer having a residual stress is removed) in a highly efficient manner. In this case, since the depth of cut in the finish grinding may be small, the aluminum substrate 32 can be ground highly efficiently while ensuring its required dimensional accuracy, surface roughness and flatness.

Thus, the double-side grinder of this embodiment comprises two pairs of grinding wheels, one of which is a pair of rough grinding wheels and the other a pair of finish grinding wheels. Therefore, as compared with the conventional double-side grinder having only one pair of grinding wheels, it is not necessary to provide a conveyance device halfway. Besides, it is not that two double-side grinders are disposed side by side, but the rough grinding mechanism 10 and the finish grinding mechanism 20 are merely connected through the carrier. Accordingly, there scarcely occurs a positional deviation caused by a secular change and it is not required to make a routine inspection so frequently, so that it is possible to reduce the running cost of the double-side grinder.

Moreover, the drop-out of the aluminum substrates 32 from the carrier 31 during conveyance thereof can be prevented by the non-contact type work holding mechanisms 35, 35' and 35" which eject a fluid from a large number of fine holes. Unlike the prior art, the aluminum substrates 32 do not come into sliding contact with a metallic guide plate. Therefore, even in the case of a soft work such as an aluminum substrate, there is no fear of its surface being flawed.

In the case where the work is an aluminum substrate, it is desirable to combine the double-side grinder shown in FIG.

Figure 3:
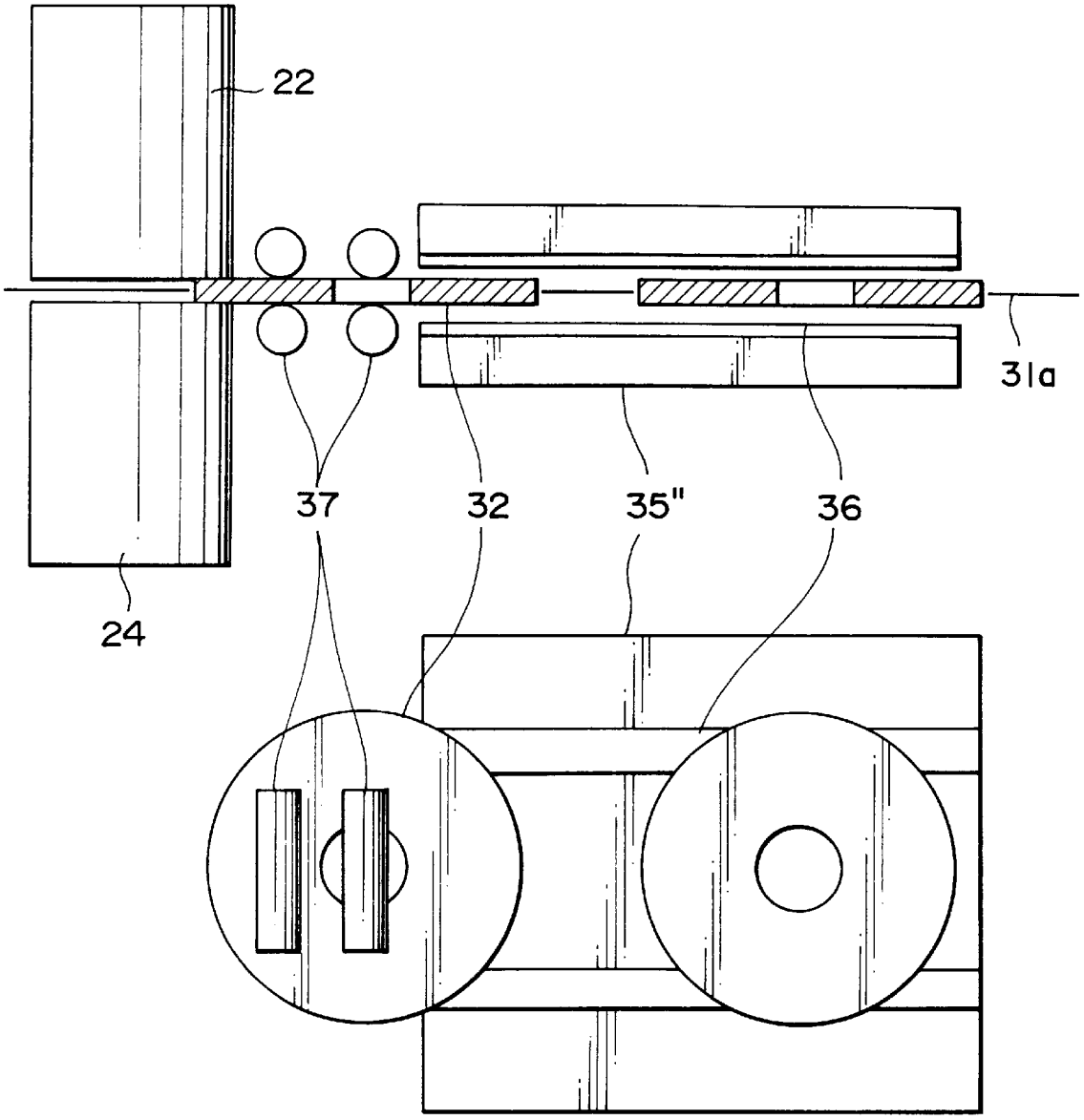
FIG. 3 is a diagram showing a positional relation between the rotation braking means and non-contact type work holding guides.

2 with the rotation braking means shown in FIG. 1. This combined construction is illustrated in FIG. 3, which is an enlarged view of the carrier outgoing side of the finish grinding wheels 22 and 24 shown in FIG. 2. Between the finish grinding wheels 22, 24 and the non-contact type work holding mechanism 35" are disposed rotation braking mechanisms 37. If the work is a doughnut-like disk as in FIG. 3, it is preferable that two sets of rotation braking mechanisms be mounted. This is because if only one set of a rotation braking mechanism is used, the brake does not act when the rotation braking mechanism is positioned in the central hole of the disk. The numeral 36 in FIG. 3 indicates a portion for the ejection of liquid or gas. Preferably, such rotation braking means are disposed at four positions of the incoming and outgoing sides of the rough grinding wheels 12, 14 and of the finish grinding wheels 22, 24.

Reference will be made below to an example in which disk-shaped works W (aluminum substrates obtained by blanking a rolled aluminum alloy plate corresponding to JIS5086 and subsequent correction of strain and soft annealing) having an outside diameter of 65 mm and an initial thickness of 0.66 mm are held on a belt-like carrier formed of stainless steel and having a plate thickness of 0.4 mm and is subjected to double-side grinding under the following conditions:

① Grinding wheel: GC#3000PVA bonded grinding wheel having an outside diameter of 455 mm and an inside diameter of 30 mm ② Outermost peripheral speed of the grinding wheel: 430 m/min ③ Direction of grinding wheel rotation: opposite to each other ④ Feed rate of a disk-shaped work: 2500 mm/min ⑤ Grinding fluid: Soluble type First, the work rotation braking means 4, 4 located on both incoming and outgoing sides of the paired grinding wheels 2 and 3 were removed and a disk-shaped work W was double-side grounded under the above conditions. As a result, 30 μm for each side could be removed and it was possible to obtain a double-side ground product having a surface roughness of 0.4 μm Rmax. However, while the disk-shaped work W leaves the paired grinding wheels 2 and 3, it was rotated together with one of the paired grinding wheels 2 and 3, causing disordered grinding marks on both of the ground surface of the work W, (at the central portion of the ground surface there are formed grinding marks extending in a uniform direction while drawing a curve according to the circular shape of the grinding wheels). Further, the outer peripheral edge of the work W were flawed as a result of having been rotated together with one of the paired grinding wheels 2 and 3 when entering and leaving the grinding wheels.

To avoid such inconvenience, the work rotation braking means 4 of the foregoing construction were used (coiled springs 4*a* having a spring constant of 10 N/m were pressed against a disk-shaped work W). In this state, a disk-shaped work W having an outside diameter of 65 mm and an initial thickness of 0.66 mm was subjected to double-side grinding. As a result, the edges of the work W were flawed. However, during movement of the work out of the paired grinding wheels 2 and 3, the rotation of the work rotation braking means 4 is braked by the braking member 4*b*, so that the work W leaves the paired grinding wheels 2 and 3 without being rotated. In this way there could be obtained a disk-shaped double-side ground product having a good appearance of both ground faces and having a flatness of not more than 10 μm. On both ground faces there remained only uniform grinding marks drawing a curve conforming to the circular shape of the grinding wheels.

When the work rotation braking means 4 of just the same construction as that of the work rotation braking means 4 disposed on the carrier outgoing side of the paired grinding wheels 2 and 3 was disposed also on the carrier incoming side, there could be obtained a disk-shaped double-side ground product having a good appearance, a flatness of not more than 10 μm and having only uniform grinding marks of a curve conforming to the circular shape of the grinding wheels on both ground faces, without any edge flaws. As described above, although in this example there was used rubber as the material of the braking member 4*b*, even the use of another synthetic resin other than rubber, or paper, cloth, bamboo, or wood, proved to afford the same effect as that obtained above.

Figure 4:
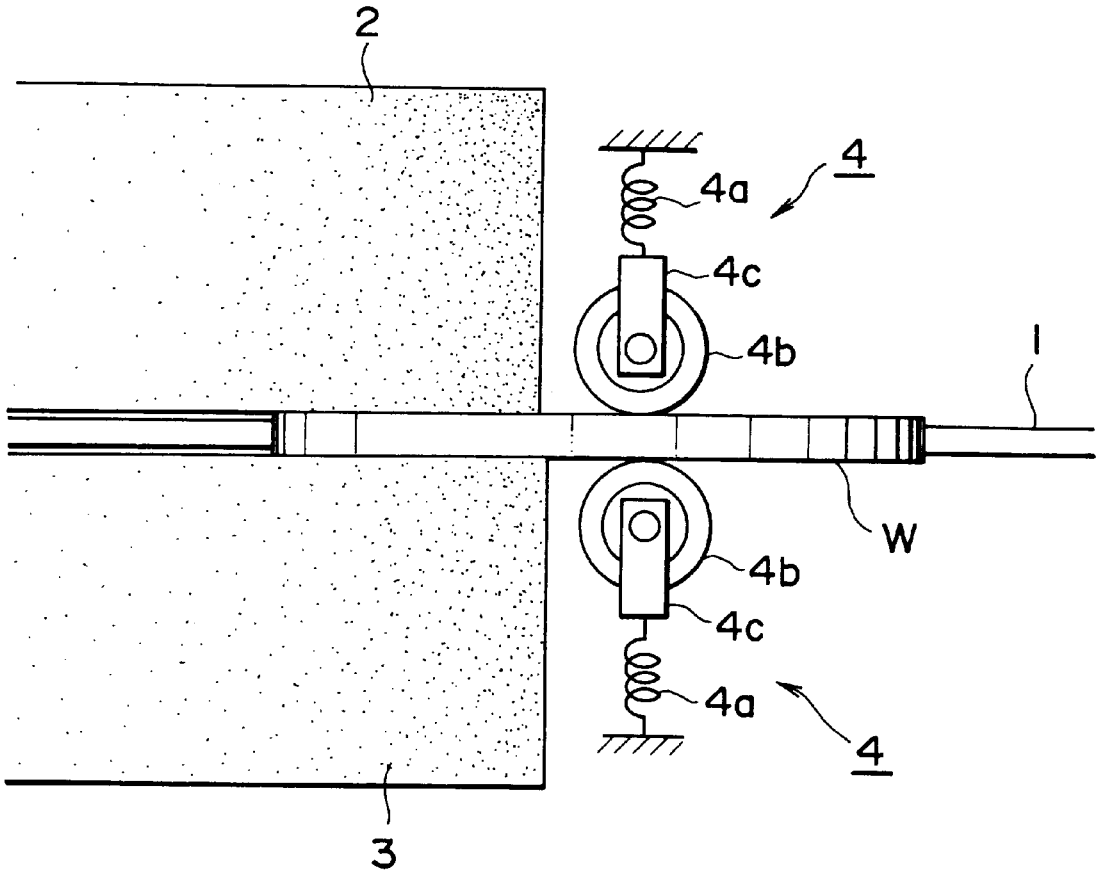
FIG. 4 is a schematic explanatory view of a double-side grinder to which is applied a rotation braking means according to a second embodiment.

Now, a double-side grinder to which is applied a rotation braking means according to a second embodiment will be described with reference to FIG. 4 which is a schematic explanatory view of the grinder and in which are shown only carrier outgoing-side work rotation braking means. The following description will be directed to only the difference from the above first embodiment, which difference resides in the construction of the work rotation braking means 4, as is best seen from FIG. 4. More specifically, the work rotation braking means 4 each comprise a coiled spring 4*a* one end of which is fixed, a roller supporting metallic piece 4*c* which is U-shaped and which is attached to an upper end of the coiled spring 4*a*, and a roller 4*b* having a rotating surface formed of rubber and adapted to rotate on a surface of the disk-shaped work W through a rotating shaft extending in a direction orthogonal to the feed direction of the carrier 1. The roller 4*b* is disposed on double-sides of the carrier 1. Of course, even if the roller 4*b* is provided on only one side of the carrier 1, there will be obtained an almost satisfactory effect.

Since the rollers 4*b*, 4*b* rotate in the feed direction of the carrier 1 but do not rotate in the rotating direction of the disk-shaped work W to brake the rotation of the work, there is obtained the same effect as that obtained in the previous embodiment. However, since the rollers 4*b*, 4*b* rotate in the feed direction of the carrier 1, they do not obstruct the traveling of the work W and a scratch induced by rubbing is difficult to occur on each surface of the work W. Besides, since the roller-work contact surface changes successively, even when foreign materials are stuck between the rollers 4*b*, 4*b* and the work W, they can be washed away easily with a grinding fluid. In these points this embodiment is superior to the previous embodiment. Actually, also according to the double-side grinder of this embodiment there could be obtained a disk-shaped double-side ground product having a good appearance with only uniform grinding marks of a curve conforming to the circular shape of the grinding wheels being found on both ground faces, and having a flatness of not more than 10 μm.

Figure 5A:
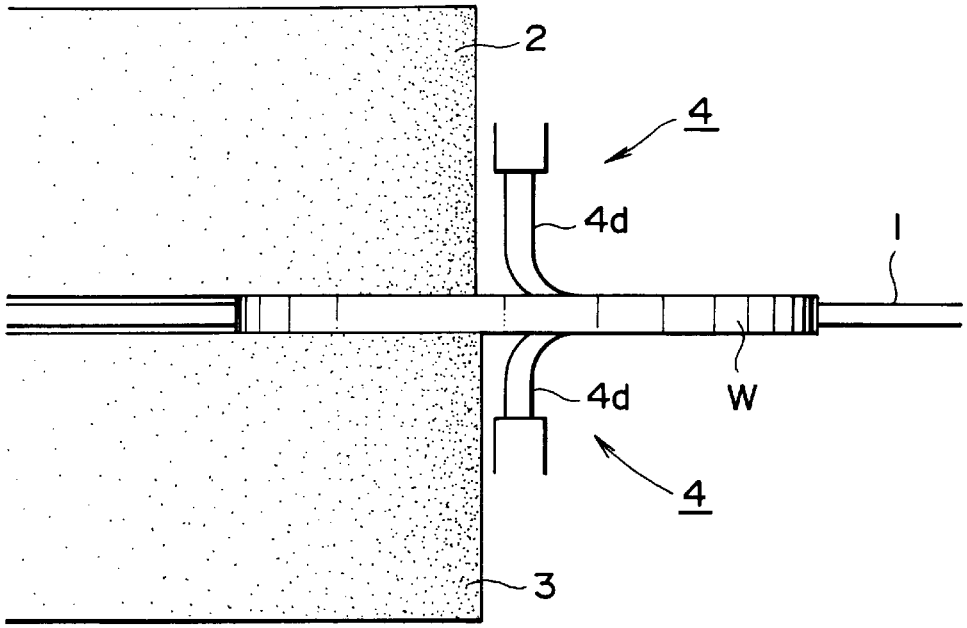
FIGS. 5(*a*) and (*b*) is a schematic explanatory view of a double-side grinder to which is applied a rotation braking means according to a third embodiment.
Figure 5B:
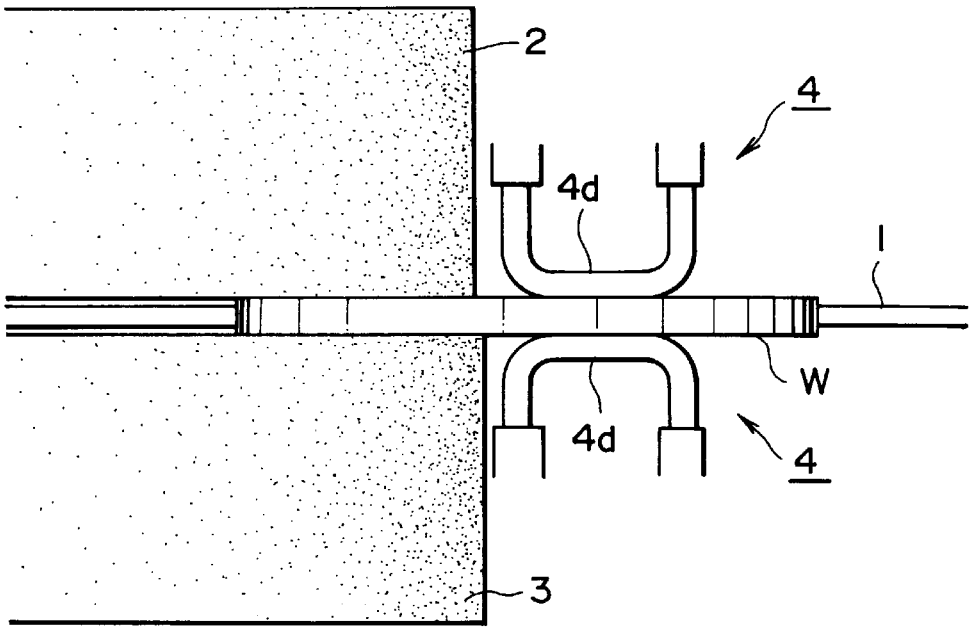

Now, a description will be given of a double-side grinder to which is applied a rotation braking means according to a third embodiment, with reference to FIGS. 5(*a*) and 5(*b*) which are schematic explanatory views of the grinder (with only outgoing-side work rotation braking means being shown). A constructional difference of the work rotation braking means from that used in the previous first or second embodiment will be explained. As shown in FIG. 5(*b*), the rotation braking means 4 comprise rubber plates 4*d*, 4*d* which are thin resinous plates. In a bent state of their front end portions in the traveling direction of the carrier 1, the rubber plates 4*d*, 4*d* come into contact with double-sides of each disk-shaped work W. Such a rubberplate 4*d* may be disposed on only one side of the carrier 1.

Since the rubber plates 4*d*, 4*d* brake the rotation of the work W, there can be obtained the same effect as in the previous first or second embodiment. Alternatively, there may be adopted such a construction as shown in FIG. 5(*b*) in which the rubber plates 4*d*, 4*d* are fixed in a U-shaped form, and the middle bent portion thereof is brought into contact with a work surface.

Actually, the double-side grinder of this embodiment, like the foregoing first or second embodiment, could afford a double-side ground product free of outer peripheral edge flaws, having a good appearance with only uniform grinding marks of a curve conforming to the circular shape of the grinding wheels being found on both ground faces of the work, and having a flatness of not more than 10 $\mu$m.

Figure 6:
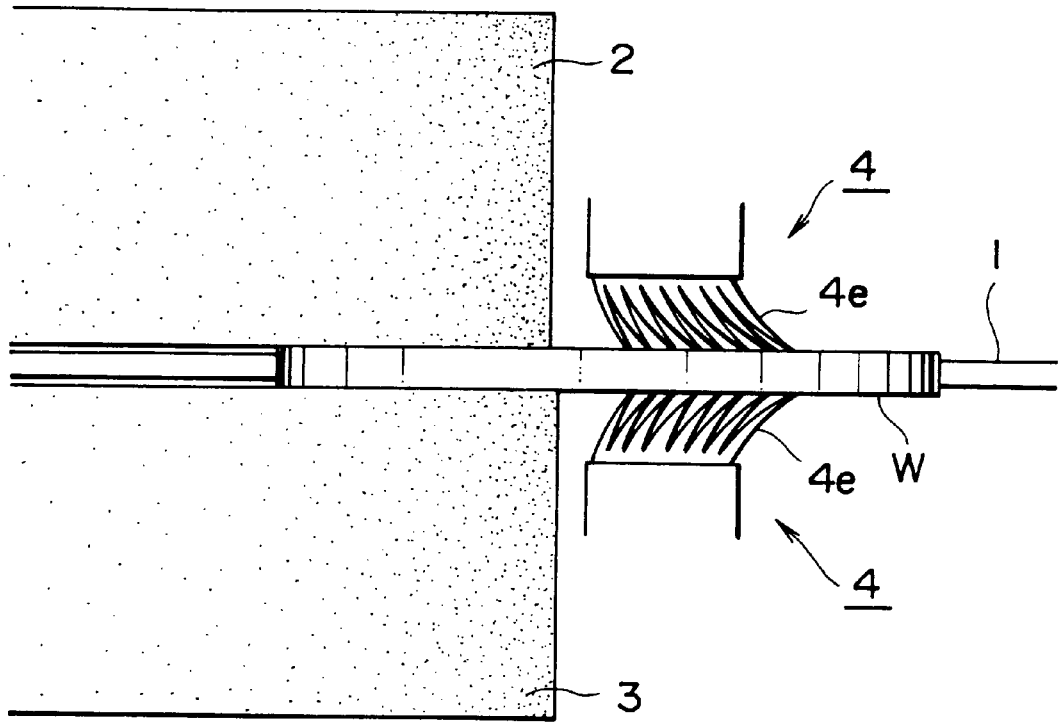
FIG. 6 is a schematic explanatory view of a double-side grinder to which is applied a rotation braking means according to a fourth embodiment.

A double-side grinder to which is applied a rotation braking means according to a fourth embodiment will now be described with reference to FIG. 6 which is a schematic explanatory view of the grinder, with only outgoing-side work rotation braking means being shown. This work rotation braking means, indicated at 4, is constructionally different from the work rotation braking means of the previous embodiment 1, 3 or 3 in that, as shown in FIG. 6, its base end side is fixed, while its front end portion comes into contact with each of double-sides of the disk-shaped work W bent wise in the traveling direction of the carrier 1. The brush 4*e* may be disposed on only one side of the carrier 1.

Since the brushes 4*e*, 4*e* brake the rotation of the disk-shaped work W, this fourth embodiment brings about the same effect as in the previous first or second embodiment. In this embodiment a grinding fluid is easy to get in between the brushes 4*e*, 4*e* and the work W and therefore this embodiment is superior to the previous first or third embodiment in point of lubrication and also in that it is easy to wash away foreign materials stuck between the brushes and the work.

Actually, the double-side grinder of this embodiment also could afford a disk-shaped double-side ground product free of edge flaws, having a good appearance with only uniform grinding marks of a curve conforming to the circular shape of the grinding wheels being found on both ground faces, and having a flatness of not more than 10 $\mu$m.

Figure 7:
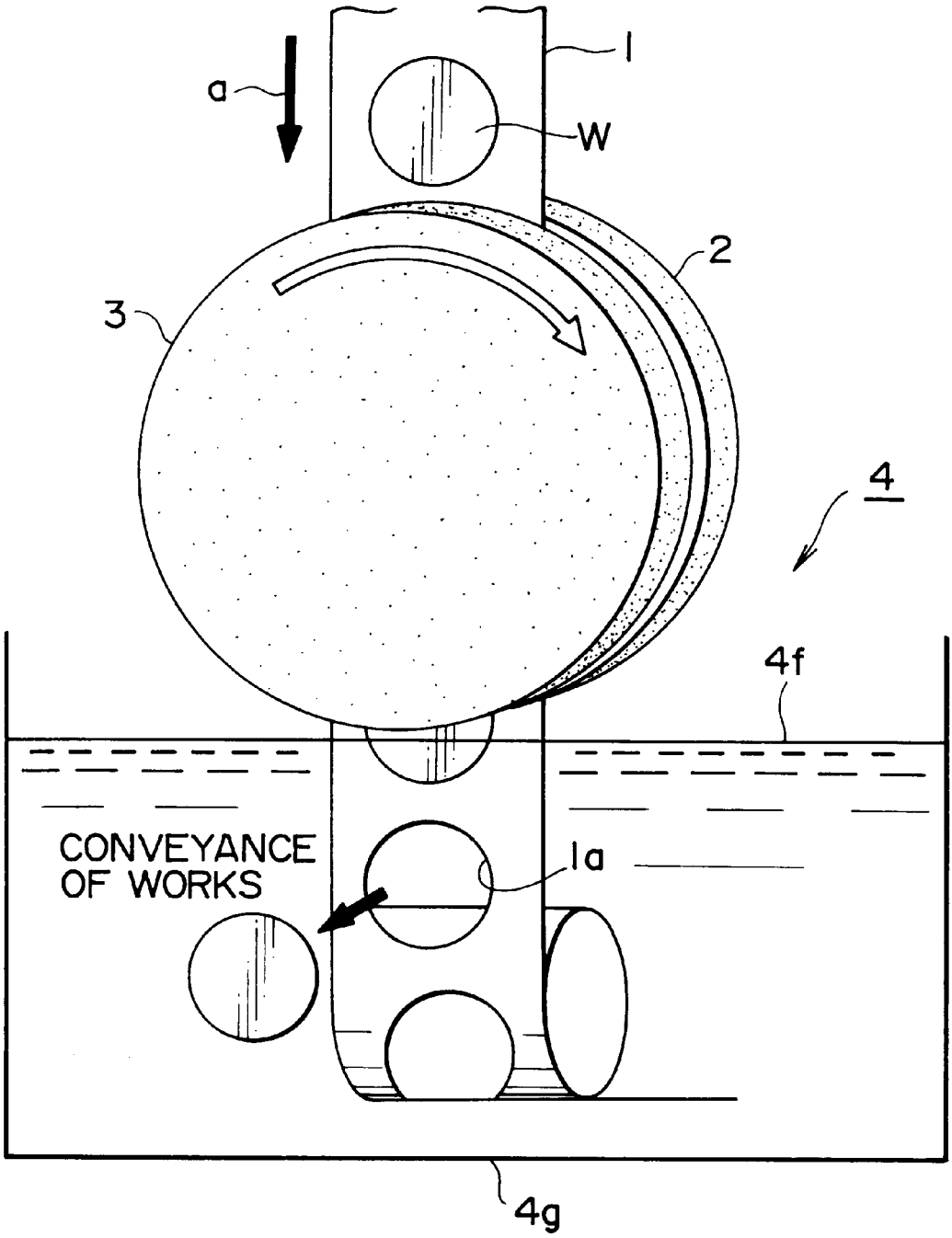
FIG. 7 is a schematic explanatory view of a double-side grinder to which is applied a rotation braking means according to a fifth embodiment.
Figure 8:
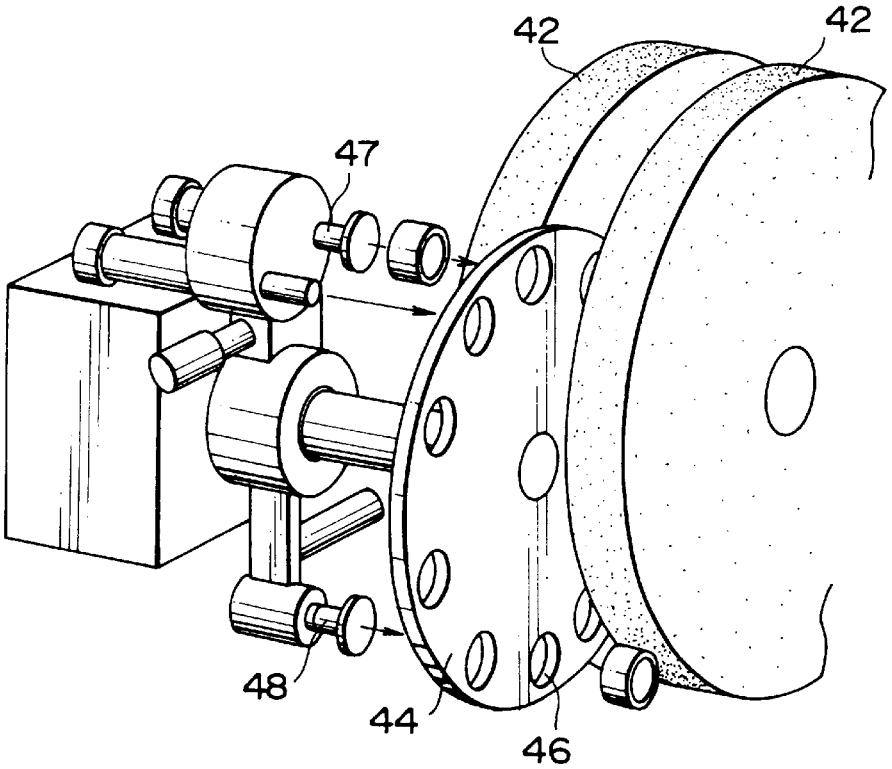
FIG. 8 PRIOR ART
FIG. 8 is a perspective view of a conventional double-side grinder (Japanese Patent Laid Open No. 108445/95)
Figure 9:
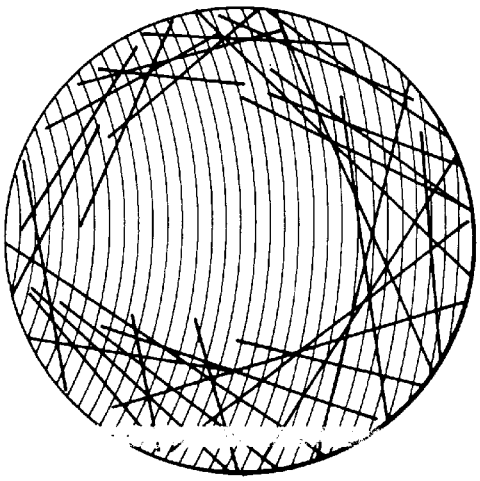
FIG. 9 PRIOR ART
FIG. 9 is a diagram explaining in what state grinding marks of a disk-shaped work occur.
Figure 10A:
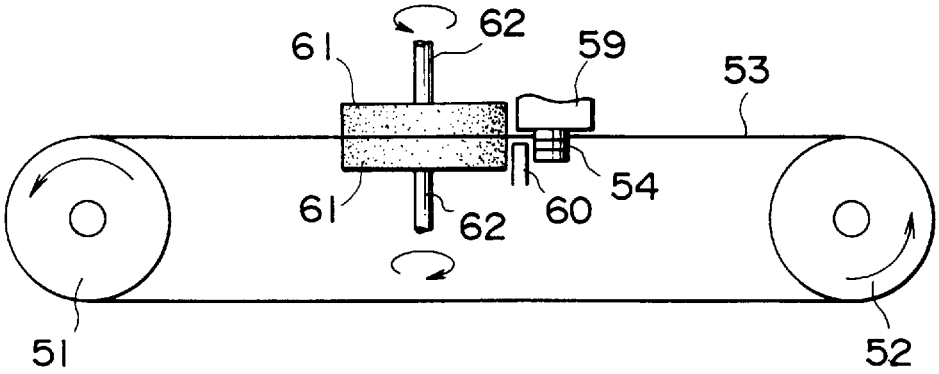
FIG. 10a PRIOR ART
FIG. 10(*a*) is a schematic explanatory view of a double-side grinder according to a prior art (Japanese Patent Publication No. 37378/80) and FIG. 10(*b*) is an enlarged view of a principal portion of the grinder shown in (*a*)
Figure 10B:
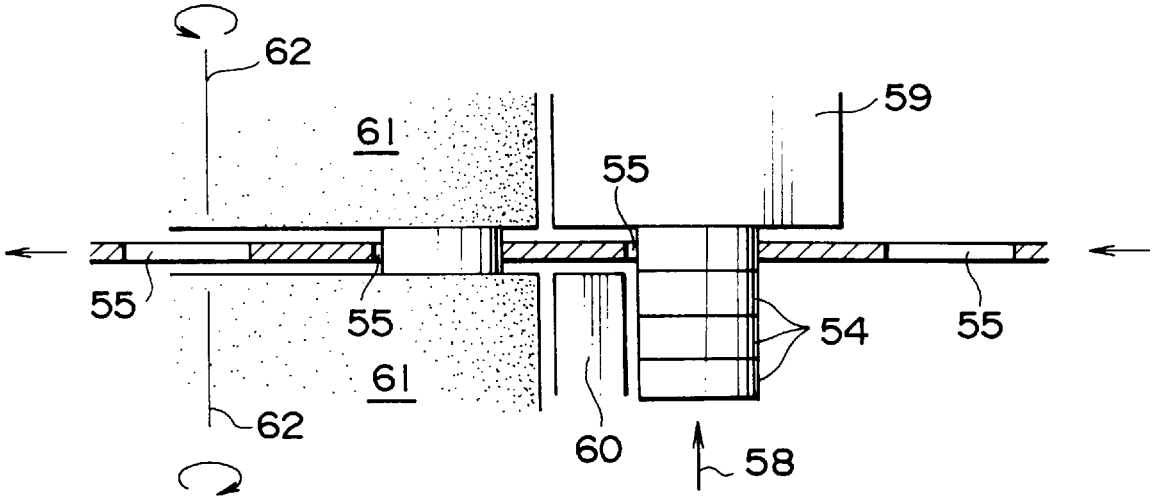
FIG. 10b PRIOR ART
Figure 11:
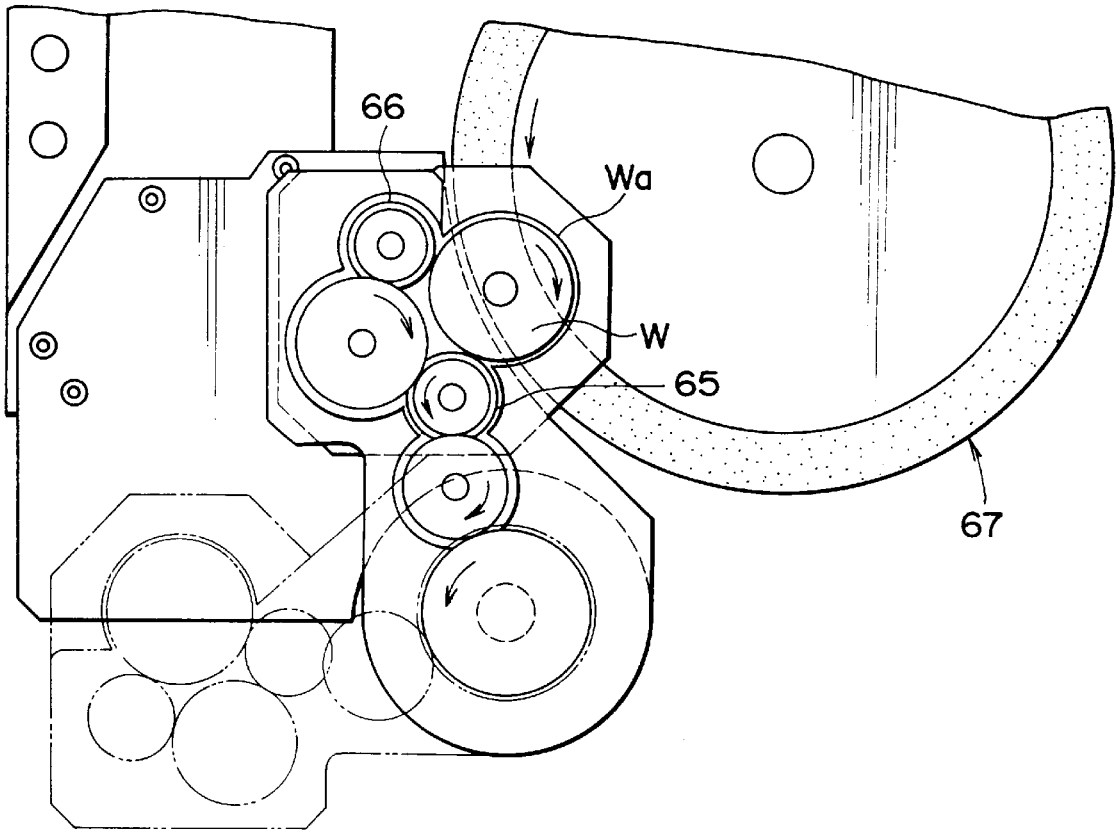
FIG. 11 PRIOR ART
FIG. 11 is a schematic plan view of a double-side grinder according to another prior art (Japanese Patent Laid Open No. 304854/94), with an upper grinding wheel being omitted.

A description will now be given of a double-side grinder to which is applied a rotation braking means according to a fifth embodiment with reference to FIG. 7 which is a schematic explanatory view of the grinder, with only outgoing-side work rotation braking means being shown. This work rotation braking means is constructionally different from that of the previous first, second, third, or fourth embodiment in that, as shown in FIG. 7, an oil tank 4 g containing a silicone oil 4*f* as a highly viscous fluid is disposed so as to be positioned with its oil level 5 mm away from the carrier outgoing side of the paired grinding wheels 2 and 3.

On the carrier incoming side were disposed the work rotation braking means adopted in each of the previous first, second and third embodiments though not shown, and grinding of the disk-shaped work W was performed in each of those cases.

According to this embodiment, since the rotation of the disk-shaped work W is braked on the carrier incoming side by the work rotation braking means adopted in any of the previous first to third embodiments and is braked on the carrier outgoing side by the viscous force of the silicone oil 4*f*, there is obtained the same effect as in the previous first to fourth embodiments.

The double-side grinder of this fifth embodiment could also afford a disk-shaped double-side ground product free from edge flaws, having a good appearance with only uniform grinding marks of a curve conforming to the circular shape of the grinding wheels being found on both ground faces, and having a flatness of not more than 10 $\mu$m. Although the above description of this fifth embodiment is based on the assumption that the highly viscous oil is a silicone oil, there is made no special limitation if only the fluid used is a less harmful, highly viscous fluid. For example, lard oil may be used.

Although the above description has been directed to the case where each double-side grinder has a pair of grinding wheels, the technical idea of the present invention is applicable also to a multi-stage double-side grinder having plural stages of paired grinding wheels. If a disk-shaped double-side ground product having a good appearance of both ground faces is to be obtained, it suffices for work rotation braking means to be disposed on the carrier outgoing side of only the final stage of grinding wheels. For obtaining a disk-shaped double-side ground product free from edge flaws and having a good appearance in both ground faces, this object can be achieved by disposing work rotation braking means on the carrier incoming and outgoing sides of the grinding wheels arranged in plural stages.

Reference will be made below to an example in which an aluminum substrate having an outside diameter of 65 mm and an initial thickness of 0.68 mm was fed continuously at a rate of 40 mm/s between rough grinding wheels disposed opposedly to each other and between finish grinding wheels disposed also opposedly to each other in each of the double-side grinders described above as embodiments, both the rough and finish grinding wheels rotating at a peripheral speed of 1000 m/min, to grind double-sides of the aluminum substrate.

More specifically, for making sure the advantage of double-side grinders according to the present invention, one hundred aluminum substrates were ground under the conditions to be described below with respect to each of various cases and then were each checked for dimensional accuracy, surface roughness and flatness. A micrometer was used for the measurement of thickness to determine a dimensional accuracy, a contact type surface roughness meter was used for the measurement of surface roughness, and a laser interference type surface shape measuring device was used for the measurement of flatness. Further, as to dimensional accuracy, it was evaluated on the basis of whether a dimensional decrease of 40 $\mu$m was attained (O) or not (X). Likewise, as to surface roughness, it was evaluated on the basis of whether a value of 0.05 $\mu$m or less was attained (O) or not (X), and flatness was evaluated on the basis of whether a value of 10 $\mu$m was attained (O) or not (X). The grinding fluid used was a soluble type.

The following conditions ① to ⑦ are grinding conditions for the aluminum substrate to be evaluated:

① Comparative Example 1 . . . A single-stage grinding was performed using GC#325 Resine-bond grinding wheels.

② Comparative Example 2 . . . A single-stage grinding was performed using GC#1000 Resine-bond grinding wheels.

③ Comparative Example 3 . . . A single-stage grinding was performed using GC#6000 PVA grinding wheels.

④ Comparative Example 4 . . . Rough grinding and finish grinding were performed continuously using GC#325 Resine-bond grinding wheels and GC#3000 PVA grinding wheels.

⑤ Comparative Example 5 . . . Rough grinding and finish grinding were performed using GC#400 Resine-bond grinding wheels and GC#800 Resine-bond grinding wheels.

⑥ Example 1 . . . Rough grinding and finish grinding were performed continuously using GC#400 Resine-bond grinding wheels and GC#1000 PVA grinding wheels.

⑦ Example 2 . . . Rough grinding and finish grinding were performed continuously using GC#800 Resine-bond grinding wheels and GC#6000 PVA grinding wheels.

The aluminum substrates used in the above working and comparative examples were evaluated for dimensional accuracy, surface roughness and flatness, the results of which are as shown in Table 1 below.

TABLE 1

| | Dimensional Accuracy | Surface Roughness | Flatness | Total Percent Acceptance |
|---|---|---|---|---|
| ① Comparative Example 1 | ○ | X | X | 0% |
| ② Comparative Example 2 | X | ○ | ○ | 50% |
| ③ Comparative Example 3 | X | ○ | ○ | 0% |
| ④ Comparative Example 4 | X | X | X | 20% |
| ⑤ Comparative Example 5 | ○ | X | X | 0% |
| ⑥ Example 1 | ○ | ○ | ○ | 100% |
| ⑦ Example 2 | ○ | ○ | ○ | 100% |

Reference to the above Table 1 shows that in Comparative Examples 1 to 5 there are included aluminum substrates incapable of satisfying any of dimensional accuracy, surface roughness and flatness, while in each of Examples 1 and 2 all of the one hundred aluminum substrates met the above criteria of dimensional accuracy, surface roughness and flatness, thus proving stable production of aluminum substrates superior in dimensional accuracy, surface roughness and flatness, and that the double-side grinding method and machine for aluminum substrates according to the present invention are extremely superior and useful industrially.

Although two examples have been described above as examples showing a continuous execution of rough grinding and finish grinding by the use of rough grinding wheels 12 and 14 with abrasive grains of #400 and #800 and finish grinding wheels with abrasive grains of #1000 and #6000, it became clear rough aluminum substrate grinding tests that rough grinding wheels 12 and 14 ranging in grain size from #400 to #1000 may be used for rough grinding of the aluminum substrate 2 and that finish grinding wheels 22 and 24 ranging in grain size from #1000 to #8000 may be used for finish grinding of the aluminum substrate.

According to the double-side grinding method and machine for disk-shaped works of the present invention, as set forth hereinabove, since the rotation of each disk-shaped work is braked on both the carrier incoming side and outgoing side of a pair of grinding wheels, there is no fear that the work may be rotated continuously or intermittently following the rotation of any one of the paired grinding wheels as is the case with the conventional double-side grinder. Thus, a great contribution can be attained to the improvement of disk-shaped ground products free of edge flaws, having a good appearance with uniform grinding marks of a curve conforming to the circular shape of the grinding wheels on both ground faces and having a good flatness.

Besides, according to the double-side grinding method and machine for aluminum substrates of the present invention, since each aluminum substrate is first roughly ground by rough grinding wheels, it is possible to grind double-sides of the aluminum substrate in a highly efficient manner while preventing loading of the work W. The aluminum substrate thus roughly ground is then finish-ground by finish grinding wheels. Thus, it is possible to grind double-sides of the aluminum substrate highly efficiently and obtain a double-side ground product superior in dimensional accuracy, surface roughness and flatness.

Moreover, since the double-side grinder of the present invention has two pairs of grinding wheels, one pair being rough grinding wheels and the other finish grinding wheels, it is not necessary to provide a conveyance device halfway as in the conventional double-side grinder using only one pair of grinding wheels. Additionally, since it is not that two double-side grinders are disposed side by side, but rough grinding wheels and finish grinding wheels are merely connected with each other through a carrier, there is no positional deviation caused by a secular change and it is not required to conduct a routine inspection so frequently, thus permitting reduction in the running cost of the grinder.

Further, according to the double-side grinder of the present invention, the drop-out of an aluminum substrate from the carrier during conveyance thereof is prevented by a non-contact type work holding mechanism, and unlike the prior art, the aluminum substrate does not come into sliding contact with a metallic guide plate, so it is not likely that the surface of the soft aluminum substrate may be flawed.

Thus, the present invention can contribute greatly to the improvement in the productivity of an aluminum substrate having high surface accuracy and dimensional accuracy and also to the improvement in yield of such aluminum substrates which is attained by preventing the occurence of surface flaws.

What is claimed is:

1. A double-side grinder for disk-shaped works, comprising:

grinding wheels disposed in an opposed relation to each other and adapted to rotate about a common axis;

a carrier adapted to pass between said grinding wheels while holding a large number of the works along a longitudinal direction of said carrier; and a work rotation braking means for braking the rotation of each said disk-shaped work held by the carrier, said work rotation braking means being disposed on at least one side of the carrier and on a carrier outgoing side of said grinding wheels.

2. A double-side grinder according to claim 1, wherein said work rotation braking means is a solid body whose hardness is lower than that of the disk-shaped works and which comes into contact with at least one side of each said disk-shaped work.

3. A double-side grinder according to claim 2, wherein said solid body is an elastic resin.

4. A double-side grinder according to claim 1, wherein said work rotation braking means comprises a solid body whose hardness is lower than that of the works and which comes into contact with at least one side of each said work, and a pressing mechanism for pressing said solid body to at least one side of the work with a predetermined certain force.

5. A double-side grinder according to claim 1, wherein said work rotation braking means comprises a roller-like solid body whose hardness is lower than that of the work and which comes into rolling contact with at least one side of each said work.

6. A double-side grinder according to claim 1, wherein said work rotation braking means is constituted by a thin resinous plate whose front end portion comes into contact with a least one side of each said work.

7. A double-side grinder according to claim 1, wherein said work rotation braking means is a brush whose front end portion comes into contact with at least one side of each said work bent wise in a carrier traveling direction.

8. A double-side grinder according to claim 1, wherein said work rotation braking means is a highly viscous fluid for immersion therein of said carrier and said works.

9. A double-side grinder according to claim 1, wherein said works are aluminum disks.

10. A double-side grinder for disk-shaped works, comprising:

grinding wheels disposed in an opposed relation to each other and adapted to rotate about a common axis;

a carrier adapted to pass between said grinding wheels while holding a plurality of the disk-shaped works; and work rotation braking means for braking the rotation of each said disk-shaped work held by the carrier, said work rotation braking means being disposed on at least one side of the carrier and on a carrier incoming side of the grinding wheels and also on at least one side of the carrier and on a carrier outgoing side of the grinding wheels.

11. A double-side grinder according to claim 10, wherein said work rotation braking means disposed on the carrier incoming side of said grinding wheels is a solid body whose hardness is lower than that of the works, and said work rotation braking means disposed on the carrier outgoing side of the grinding wheels is a highly viscous fluid for immersion therein of the carrier and the works.

12. A double-side grinder comprising:

a belt-shaped carrier for holding aluminum substrates along a longitudinal direction of said carrier;

a carrier moving mechanism for moving said carrier while applying a tension to the carrier;

a pair of rough grinding wheels disposed on double-sides of the carrier at predetermined intervals in the longitudinal direction of the carrier, said pair of rough grinding wheels rotating about a common axis to roughly grind each said aluminum substrate held by the carrier; and a pair of finish grinding wheels for finish-grinding the aluminum substrate after being ground roughly by the paired rough grinding wheels.

13. A double-side grinder according to claim 12, wherein said paired rough grinding wheels comprise abrasive grains of approximately 11.5 to 30 $\mu$m and said paired finish grinding wheels comprise abrasive grains of approximately 1.2 to 11.5 $\mu$m.

14. A double-side grinder according to claim 12, wherein a non-contact type work holding guide for ejecting a fluid to the aluminum substrates held by the carrier to prevent drop-out of the aluminum substrates from the carrier is disposed in a position outside the carrier.

15. A double-side grinder according to claim 14, further comprising a work rotation braking means for braking the rotation of each said work held by the carrier, said work rotation braking means being disposed on at least one side of the carrier and on the carrier outgoing side of said grinding wheels.

16. A double-side grinder according to claim 12, further comprising a work rotation braking means for braking the rotation of each said work held by the carrier, said work rotation braking means being disposed on at least one side of the carrier and on the carrier outgoing side of said grinding wheels.

17. A double-side grinding method for aluminum substrates, involving passing a belt-shaped carrier between grinding wheels disposed in an opposed relation to each other and adapted to rotation about a common axis, and grinding double-sides of each said aluminum substrates, wherein a rough grinding using rough grinding wheels of approximately 11.5 to 30 $\mu$m and a finish grinding using finish grinding wheels of approximately 1.2 to 11.5 $\mu$m are performed continuously in grinding the aluminum substrate.

* * * * *